US007270248B2

(12) United States Patent
Schroeder

(10) Patent No.: US 7,270,248 B2
(45) **Date of Patent: *Sep. 18, 2007**

(54) ADJUSTABLE DISPENSER FOR SOFT PLIABLE LIDS

(76) Inventor: Roy D. Schroeder, 11344 Road Z, Columbus Grove, OH (US) 45830

( * ) Notice: Subject to any disclaimer, the term of this patent is extended or adjusted under 35 U.S.C. 154(b) by 209 days.

This patent is subject to a terminal disclaimer.

(21) Appl. No.: 10/979,287

(22) Filed: Nov. 2, 2004

(65) Prior Publication Data

US 2005/0092767 A1 May 5, 2005

Related U.S. Application Data

(60) Provisional application No. 60/516,722, filed on Nov. 3, 2003.

(51) Int. Cl.
*B65H 3/28* (2006.01)
*G07F 11/16* (2006.01)

(52) U.S. Cl. ..... 221/221; 221/222; 221/223; 221/36; 221/277; 221/297

(58) Field of Classification Search ..... 221/1–312 C
See application file for complete search history.

(56) References Cited

U.S. PATENT DOCUMENTS

| | | | | |
|---|---|---|---|---|
| 1,095,319 | A | | 5/1914 | Erwin |
| 1,503,691 | A | | 8/1924 | Love |
| 1,657,850 | A | | 1/1928 | Barbieri |
| 1,667,483 | A | | 4/1928 | Leof |
| 1,767,634 | A | | 6/1930 | Weiss |
| 2,426,707 | A | | 9/1947 | Polsen et al. |
| 2,556,740 | A | * | 6/1951 | Polsen et al. ..... 221/77 |
| 2,695,125 | A | * | 11/1954 | Bowen ..... 53/299 |
| 2,942,758 | A | | 6/1960 | Hogstrom |
| 3,455,484 | A | | 7/1969 | Edwards |
| 3,581,937 | A | | 6/1971 | Johnson et al. |
| 3,756,452 | A | | 9/1973 | Buhayer et al. |
| 4,184,523 | A | | 1/1980 | Carrigan et al. |
| 4,241,848 | A | | 12/1980 | Young |
| 4,319,441 | A | | 3/1982 | Credle |
| 4,643,334 | A | | 2/1987 | Steele |
| 4,949,526 | A | | 8/1990 | Brogna et al. |
| 4,963,072 | A | * | 10/1990 | Miley et al. ..... 414/797.6 |
| 5,038,969 | A | | 8/1991 | Berger |
| 5,131,562 | A | | 7/1992 | Brown |
| 5,172,828 | A | | 12/1992 | Ficken et al. |
| 5,322,188 | A | | 6/1994 | Dodaro |

(Continued)

*Primary Examiner*—Gene O. Crawford
*Assistant Examiner*—Michael K Collins
(74) *Attorney, Agent, or Firm*—Stevens & Showalter, LLP

(57) ABSTRACT

A dispenser for dispensing flexible lids includes a housing having a lid stack holder for containing a coaxial stack of lids. Lids are supported within a substantially coaxial channel of the lid stack by a pair of opposing indexing shafts that rotate upon operation of a user operable drive device to pass a bottom-most lid to a discharge area. The drive device may be calibrated to rotate the indexing shafts by an adjustable amount that is determined, at least in part, by the height of each lid and/or the spacing between lids in the stack. Further, the housing may be constructed from a fixed housing portion and an adjustable housing portion. The adjustable housing portion allows the spacing between the indexing shafts to be adjusted to correspond to the circumference of the lids currently being dispensed.

27 Claims, 8 Drawing Sheets

U.S. PATENT DOCUMENTS 5,328,052 A * 7/1994 Kizilos ..... 221/42
5,383,571 A * 1/1995 Gunderson ..... 221/223
5,738,246 A 4/1998 Chung
5,944,220 A 8/1999 Garske et al.
5,960,989 A * 10/1999 Gunderson ..... 221/220
6,786,359 B1 * 9/2004 Schroeder ..... 221/222
6,832,698 B1 12/2004 Dybul
2006/0157493 A1 * 7/2006 Christoffersen et al. ..... 221/36

* cited by examiner

ADJUSTABLE DISPENSER FOR SOFT PLIABLE LIDS

CROSS REFERENCE TO RELATED APPLICATIONS

This application claims the benefit of U.S. Provisional Application No. 60/516,722 filed Nov. 3, 2003 entitled "Adjustable Dispenser For Soft Pliable Lids", which is incorporated herein by reference.

BACKGROUND OF THE INVENTION

The present invention relates in general to dispensing devices and in particular to devices for dispensing flexible lids for containers.

Many restaurants, convenience markets and other establishments serve items including beverages and food to customers in paper, plastic, Styrofoam, and other disposable containers. As a convenience to the customers, a corresponding disposable lid is typically sealed around an open end of such containers to keep their contents from spilling or otherwise upsetting. In many establishments, the disposable lids are kept in generally horizontal or slightly inclined trays that are positioned near the location where their associated containers are dispensed. However, the lids sometimes stick together causing slow downs in retrieving a single lid from the lid tray. Further, a person typically touches several lids when attempting to retrieve a single lid. For example, a person wishing to obtain a lid from a lid tray must typically grasp multiple lids, often requiring the use of two hands to separate out a single desired lid. This practice creates the likelihood that the counter on which the lid tray is positioned will become cluttered with loose lids lying in the proximity to the lid tray. Still further, typical lid trays consume considerable amounts of valuable counter space thus affecting the store space required to serve beverages.

SUMMARY OF THE INVENTION

The present invention provides a lid dispenser that is operative to dispense a single lid at a time, and which is adjustable to accommodate lids of various heights and/or various circumferences.

A dispenser is provided for dispensing flexible lids. The dispenser includes generally, a housing, a lid stack holder for storing a coaxial stack of lids and a manually operable control. The lids are delivered from the lid stack holder through the housing via a substantially coaxial channel, and are supported inside the housing by a pair of opposing indexing shafts. Upon operation of the control, a drive device causes the indexing shafts to rotate in opposite directions so as to pass the bottom-most lid to a discharge area accessible to the operator. The drive device may include an adjustment control or feature that allows the dispenser to be calibrated to rotate the indexing shafts by an adjustable amount that is determined, at least in part, by the height of each lid in the stack of lids and/or the spacing between lids in the stack. For example, certain lids, e.g., coffee container lids, may be "taller" than soft drink lids. Other lid types may have flares or flanges at their perimeter, which affects the overall spacing between lids in the stack. The adjustment control thus allows the same dispenser to be used with a plurality of different styles of lids having different lid heights or lid stacking characteristics. Further, the housing may be constructed from a fixed housing portion and an adjustable housing portion. The adjustable housing portion allows the spacing between the indexing shafts to be adjusted to correspond to the circumference of the lids currently being dispensed.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals, and in which.

DETAILED DESCRIPTION OF THE PREFERRED EMBODIMENTS

Figure 1:
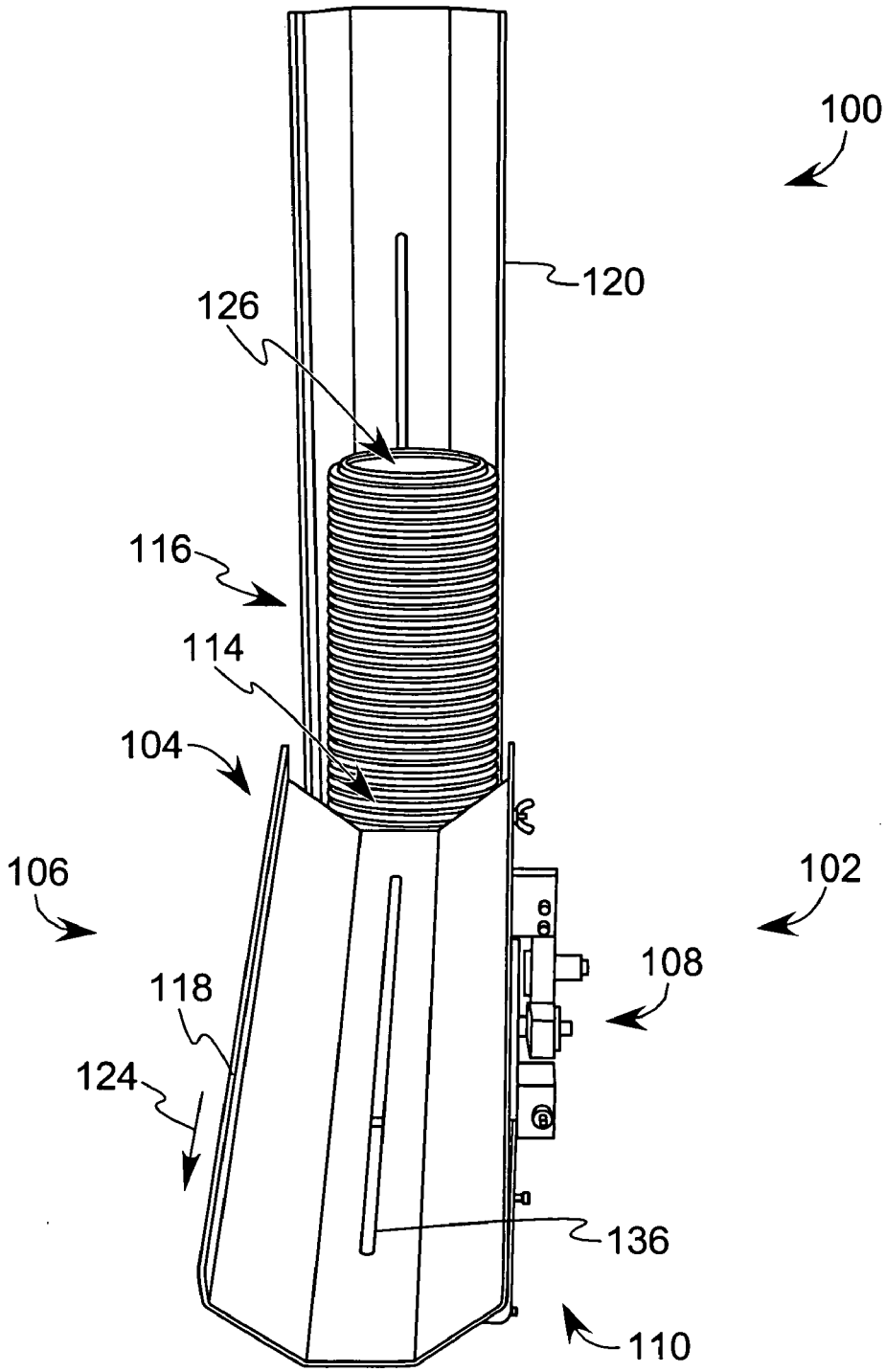
FIG. 1 is a front view of a lid dispenser where a lid stack holder of the dispenser is shown in an open position for loading lids therein.

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention. Further, like structure is referred to with like reference numerals throughout.

Figure 2:
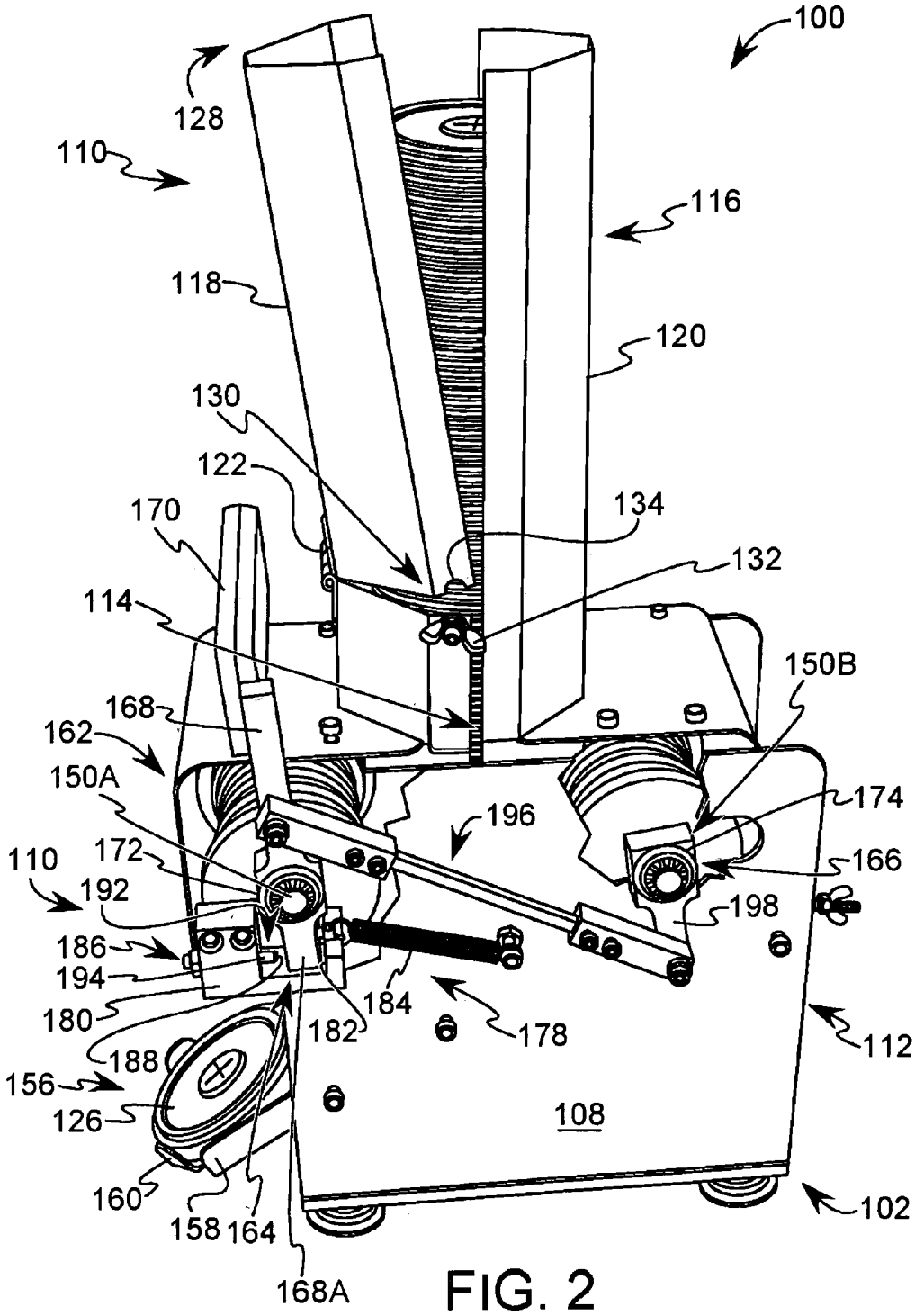
FIG. 2 is a side view of the lid dispenser of FIG. 1, where a portion of a housing of the dispenser is cut away to illustrate the relationship between certain components within the housing and corresponding components outside the housing for illustrative purposes.

As shown generally in FIGS. 1 and 2, a dispenser 100 includes a housing 102 having a top surface 104, a pair of side surfaces 106, 108, a front face 110, and a back face 112. A lid feed aperture 114 is provided through the top surface 104 of the housing 102 defining a channel between the housing 102 and a lid stack holder 116. The lid stack holder 116 is provided generally about the top surface 104 of the housing 102 so as to align generally coaxially with the lid feed aperture 114.

The lid stack holder 116 includes a first support member 118 and a second support member 120. The first support member 118 is pivotably connected to the housing 102, e.g., by a hinge 122 (seen in FIG. 2). As shown in FIG. 1, the first support member 118 may be pivoted to an open (first) position 124, which defines a position suitable for loading the dispenser 100 with a plurality of generally coaxially stacked lids 126. The lids 126 are typically flexible lids, and are available in a variety of styles, sizes and materials. For example, flexible lids are often provided with cups for holding fountain drinks, coffee and other beverages. When a suitable quantity of lids 126 is installed within the lid stack holder 116, the first lid member 118 is pivoted to a closed (second) position 128 (shown in FIG. 5) for operation. The lid stack holder 116 thus stores the lids 126 for dispensing. Moreover, the lid stack holder 116 may provide at least one alignment surface arranged to support the substantially vertical stack of lids 126. For example, the lid stack holder 116 may maintain the lids 126 generally in the vertically stacked position, and may prevent the lids 126 from leaning excessively while loaded in the dispenser 100. During use, lids 126 will pass from the lid stack holder 116 through the lid feed aperture 114 into the housing 102.

Referring to FIG. 2, the lid stack holder 116 includes one or more locking members 130 to secure the first support member 118 in the closed position 128. For example, a bolt and wing nut assembly 132 may be provided on opposite sides of the lid stack holder 116. The first support member 118 includes a corresponding pair of oppositely spaced slots 134 arranged such that each slot 134 slidingly receives the shaft of the associated bolt when the first support member 118 is rotated into the closed position 128. Once the first support member 118 is suitably rotated into the closed position 128, the wing nut is tightened down, such as by hand, and the dispenser 100 is ready for use.

The lid stack holder 116 thus defines an area within and/or about the housing 102 where the lids 126 are cued for dispensing. However, other arrangements may alternatively be used to load the stack of lids 126 into the dispenser 100. For example, the lid stack holder 116 may be integral with, and/or contained within the housing 102. Under such an arrangement, the housing may have a lid access aperture on a top surface which is arranged such that lids may be dropped down through the lid access aperture into a feeder area as described in U.S. Pat. No. 6,786,359, filed Sep. 29, 2001 entitled DISPENSER, the disclosure of which is hereby incorporated by reference in its entirety.

As best seen in FIG. 1, the dispenser 100 may also further comprise an optional guide slot 136 through the front face of the first support member 118. The guide slot 136 is aligned generally to expose at least a portion of a lid stacking area defined within the lid stack holder 116 and may be used for example, to provide a visual indication of the level of lids 126 in the lid 10 stack holder 116. The guide slot 136 may further optionally allow a user to reach into the lid stack holder 116 from the outside of the housing 102 to make adjustments to the stack of lids 126, such as when loading the dispenser 100, or to plumb or otherwise straighten a stack of lids 126 already stored therein.

Figure 3:
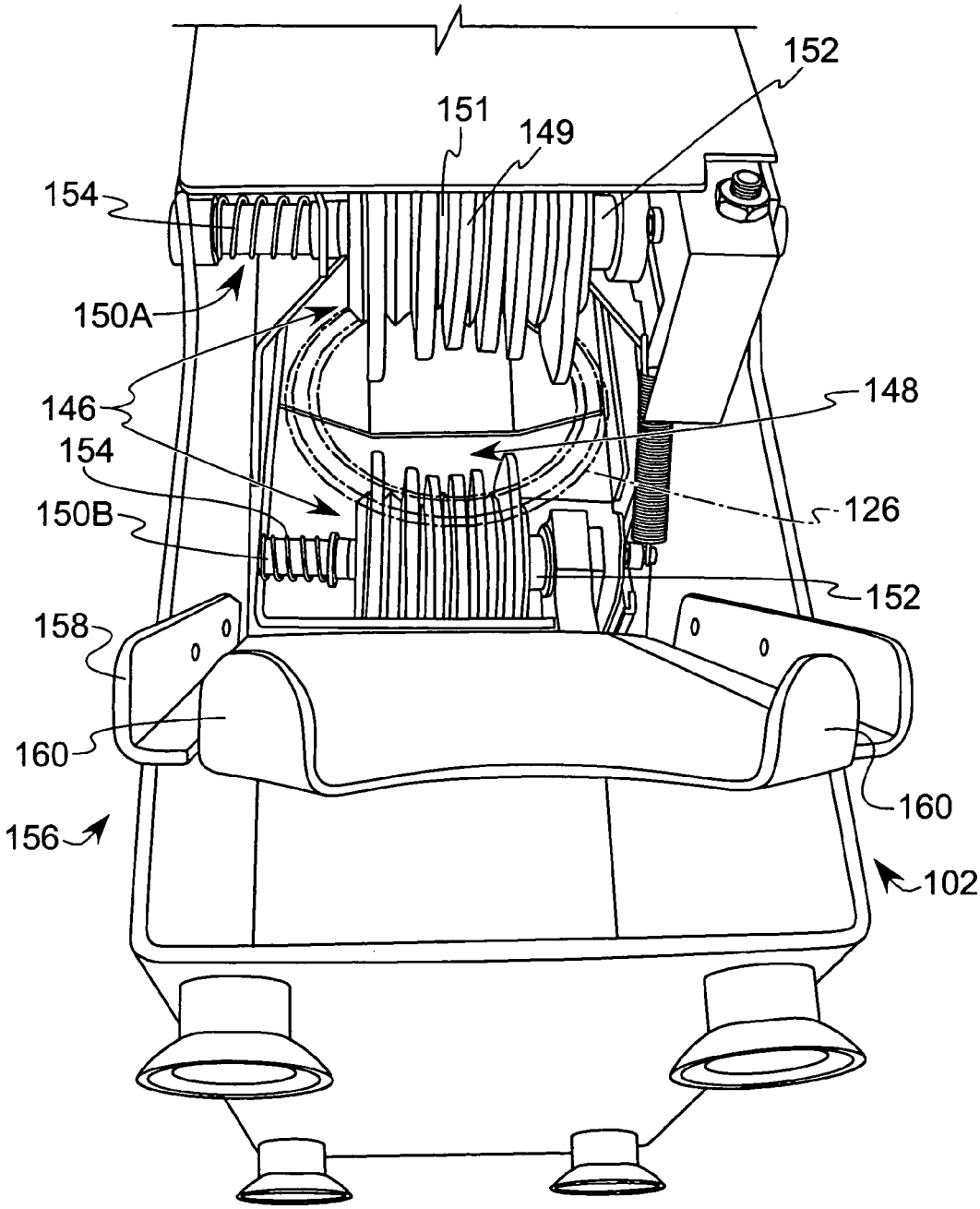
FIG. 3 is a bottom view of the lid dispenser of FIG. 1 taken at an angle from the front face illustrating a pair of indexing shafts and grippers that support a stack of lids loaded for dispensing.
Figure 4:
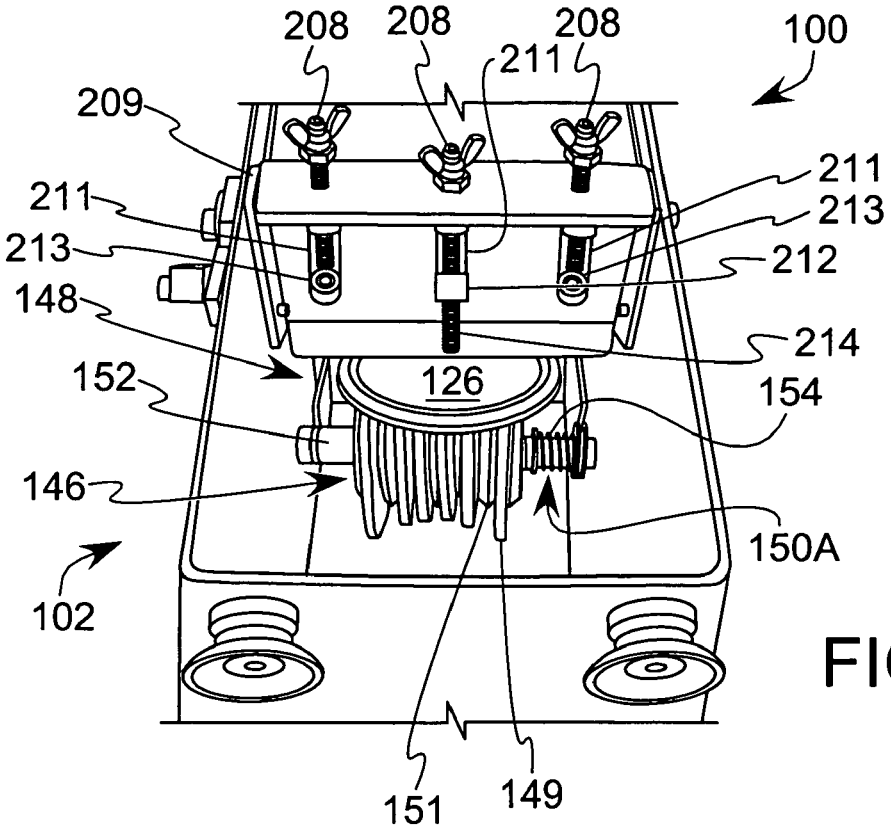
FIG. 4 is a bottom view of the lid dispenser of FIG. 1 taken at an angle from a rear face illustrating an adjustment mechanism to accommodate lid stacks of various circumferences, and the front indexing shaft and corresponding gripper.

The dispenser 100 is particularly suited for serially dispensing lids 126, and more particularly, for sequentially dispensing a bottom-most lid from a substantially coaxially aligned stack of lids 126. Referring to FIGS. 3 and 4, the stack of lids 126 are lowered into the housing 102 until the bottom-most lid is brought to rest against a pair of opposing grippers 146. FIG. 3 is a view looking up from the bottom and at a slight angle from the front of the housing 102, and FIG. 4 is a corresponding view looking up from the bottom and at a slight angle from the back of the housing 102. In FIG. 4, the rearmost gripper 146 is obscured from view by other components of the dispenser 100, which will be described in greater detail herein. As shown, the pair of opposing grippers 146 is oriented such that their respective axis runs side to side within the housing 102. However, other configurations may alternatively be implemented.

As the stack of lids 126 is passed down from the lid stack holder 116 into the housing 102, at least the bottom-most lid of the stack of lids 126 will come to rest in cooperation with the grippers 146. Referring to FIG. 3, the two grippers 146 flank to either side of the bottom-most lid. The grippers 146 are provided so as to define a supporting relationship with one or more of the lids 126 and may be sufficient to support the stack of lids 126. For example, the grippers 146 may apply a slight frictional pressure tangentially against a flanged portion, or rim of at least the bottom-most lid 126. Moreover, the grippers 146 define a discharge location 148 at a nip point defined between the grippers 146. As shown, the discharge location 148 is aligned substantially coaxially with the lid stack holder 116.

The grippers 146 are implemented as feed rollers and may comprise a deformable material that is oriented to support the stack of lids 126. The feed rollers provide a positive gripping action on at least the bottom-most lid within the stack of lids 126, yet are sufficiently compliant to avoid causing excess deflection or damage to the lids 126. Each of the feed rollers may be formed from any number of materials, such as foam, rubber, plastic, cloth, or other suitable material. For example, the grippers can comprise any of the embodiments illustrated in U.S. Pat. No. 6,786,359, which is already incorporated by reference herein. Foam or other soft, pliable materials may allow for some variances in the circumference of various lids placed in the dispenser without requiring adjustments to the positioning of the grippers 146.

As shown, each gripper 146 comprises a plurality of generally cylindrical disks 149 arranged such that the circumference of ones of said plurality of disks 149 at the end portions of each gripper 146 are nominally larger than the ones of said plurality of disks at the middle portion of said gripper 146. Each of the cylindrical disks 149 is axially spaced from one another by a suitable spacer 151. The spacers 151 may be formed of a material that allows the axial spacing of the disks 149 to be altered, e.g., by using a deformable material. Such an arrangement allows the disks 149 to be positioned so as to be conform generally, to the circumference of the lids 126 loaded in the dispenser 100. That is, the spacers 151 between each of the disks 149 are arranged to allow the disks 149 to be spaced axially so as to adjust to varying circumferences of stacks of lids 126 placed in the dispensing device 100. As such, the grippers 146 each hold the bottom-most lid 126 in a plurality of different positions about the periphery of a corresponding bottom-most lid.

Each gripper 146 is supported by an associated one of a pair of indexing shafts 150A, 150B, which are appropriately journaled for axial rotation within the housing 102. The grippers 146 may be secured either permanently or temporarily to an associated indexing shaft 150A, 150B so long as the grippers 146 rotate with their respective indexing shaft 150A, 150B in at least one direction when installed within the housing 102. The indexing shafts 150A, 150B are generally positioned within the same horizontal plane and are aligned axially parallel to one another. However, the indexing shafts 150A, 150B may be positioned in any position so long as indexing shafts 150A, 150B can be brought to rotate in such a manner so as to pass a bottom-most lid therebetween. For example, as shown, the indexing shafts 150A, 150B are journaled through the sides of the housing 102. In practice however, the indexing shafts 150A, 150B may be secured in any manner (e.g., front and back or side to side) that allows rotational movement thereof. An example of mounting the indexing shafts front to back is disclosed in U.S. Pat. No. 6,786,359, which is already incorporated by reference herein.

The indexing shafts 150A, 150B may optionally include arrangements to suitably position the grippers 146 with respect to the stack of lids 126. For example, as shown, a spacer 152 is positioned on each indexing shaft 150A, 150B to a first side of the gripper 146. A corresponding gripper biasing spring 154 is positioned on each indexing shaft 150A, 150B on the opposite side of the spacer 152. The gripper biasing spring 154 can optionally be replaced by a second spacer 152. Adjustment to the spring 154 and/or the spacer 152 may be implemented to affect the relative positioning of the disks 149 along the corresponding indexing shaft 150A, 150B.

Figure 6:
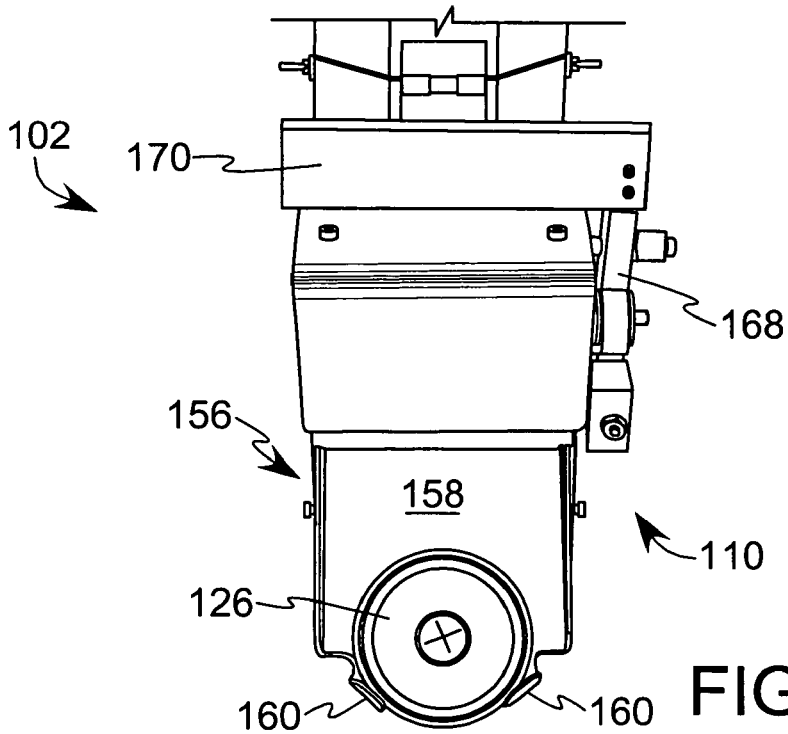
FIG. 6 is a front view of the lid dispenser of FIG. 1 where a lid has been discharged onto a discharge table of the dispenser.

Referring to FIG. 3, to dispense a lid 126, the opposing pair of indexing shafts 150A and 150B is brought to rotate the grippers 146 in opposite directions by an amount sufficient to pass the bottom-most lid of the stack of lids 126 past the discharge location 148. The bottom-most lid is then gravity fed out of the housing 102 to the discharge area 156. Referring to FIG. 6, the discharge area 156 is implemented as a delivery table 158, which comprises a surface that is angled forward and has a low surface energy such that a lid 126 that discharges from the housing 102 onto the delivery table 158 will slide forward in a single, continuous, gravity driven action. The delivery table 158 is not necessary, but it does allow the dispenser 100 to be suitable for setting on a counter top, mounting within cabinets or drawers, hung or otherwise suspended on walls, or are provided in any other installation desired. The delivery table 158 optionally further includes a lid catch 160 that provides an abutment surface for lids that slide down the delivery table 158 to prevent cluttered or otherwise disorganized workspaces.

Referring to FIG. 2, extending from one side of the housing 102 is a dispensing mechanism 162 for manually dispensing the lids 126. The dispensing mechanism 162 includes a first driving device 164 and a second driving device 166. The first driving device includes a first handle member 168 and a second handle member 170 coupled to the first handle member 168. The second handle member 170 cantilevers across and above the housing 102 and provides a convenient user operative control for manually dispensing lids 126 by providing a large, wide structure conveniently positioned for user interaction. However, the first handle member 168 and corresponding second handle member 170 may be replaced by any desired lever or other control.

The first driving device 164 is coupled to the first indexing shaft 150A via a one-way bearing 172. The one-way bearing 172 conceptually performs in a manner similar to a ratcheting type action. More particularly, when the first handle member 168 is rotated about the one-way bearing 172 in a first direction, e.g., clockwise, the first indexing shaft 150A rotates in unitary rotational motion with the first handle member 168. However, when the first handle member 168 is rotated about the one-way bearing 172 in a second direction, the first indexing shaft 150A remains stationary with respect to the first handle member 168. Similarly, the second driving device 166 is coupled to the second indexing shaft 150B via a one-way bearing 174. However, the one-way bearing 174 is configured opposite of the one-way bearing 172. That is, when the one-way bearing is rotated in the first direction, e.g., clockwise, the second indexing shaft 150B remains stationary. However, when the one-way bearing 174 is rotated in the second direction, e.g., counter clockwise, the second indexing shaft 150B rotates.

A handle bias 178 is provided to maintain the lever 162 in a ready position for use. The handle bias 178 includes a block 180 positioned that defines a first abutment surface 182 to resist the rotational movement of the first handle member 168 and a spring 184 positioned to urge the first handle member 168 against the first abutment surface 182. By positioning the first abutment surface 182 and spring 184 towards the back face of the dispenser 100 with respect to the first handle member 168, the lever 162 is biased in a forward position such that pushing either the first or second handle members 168, 170 operates the dispenser 100.

A lid height adjustment 186 is also provided to allow the dispenser 100 to be adjusted to accommodate the height of the particular lids to be dispensed. The lids 126 are typically flexible, concavo-convex plastic structures having a generally flat and circular top surface, and a annular flanged rim extending from the top surface, allowing the lids 126 to form in a stack. However, the configuration of the lids 126 may vary depending upon the beverage container (not shown) for which the lids 126 are designed. For example, the lids 126 may have raised rims, inclined or otherwise outwardly flared lip or edge portions, flanges or other features. To account for the differences in the height of the lids, the lid height adjustment 186 comprises a repositionable second abutment surface 188 that limits the degree of rotational movement capable by the first handle member 168.

As one example, the handle bias 178, first abutment surface 182 and lid height adjustment 186 are integrated into the block 180. As shown, the block 180 includes a recessed portion 192 for receiving the lower end portion 168A of the first handle member 168. The spring 184 is coupled to the first handle member 168 below the one-way bearing 172 and extends towards the back face of the dispenser 100. The spring 184 biases the first handle member 168 against a first wall in the recessed portion of the block 180 defining the first abutment surface 182. An adjustment control including a repositioning device 194, such as a set screw, is adjustably threaded through the block 180 and extends through a second wall in the recessed portion opposite the first wall defining the second abutment surface 188. The lower end portion 168A of the first handle member 168 seats between the first and second walls of the recessed portion 192 of the block 180. Accordingly, the distance between the first and second abutment surfaces define bounds for the degree to which the first handle member 168 may be pivoted. As an example, when dispensing lids 126 having relatively tall rim portions, or for lids that are otherwise spaced relatively far apart when stacked, the adjustment control can be set to allow a relatively great degree of rotation of the indexing shafts 150A, 150B. To set the adjustment control, an operator sets the distance between the first and second abutment surfaces 182, 188 by adjusting the repositioning device 194, e.g., by adjusting the setscrew. For relatively short rimmed lids 126, the spacing between the first and second abutment surfaces 182, 188 can be shorted to an appropriate amount by setting the adjustment control such that the distance between the first and second abutment surfaces 182, 188 alters the bounds for the degree to which the first handle member 168 may be pivoted in a manner that corresponds to an amount of rotation of the indexing shafts 150A, 150B necessary to pass the bottom-most lid from the stack of flexible lids 126.

Figure 5:
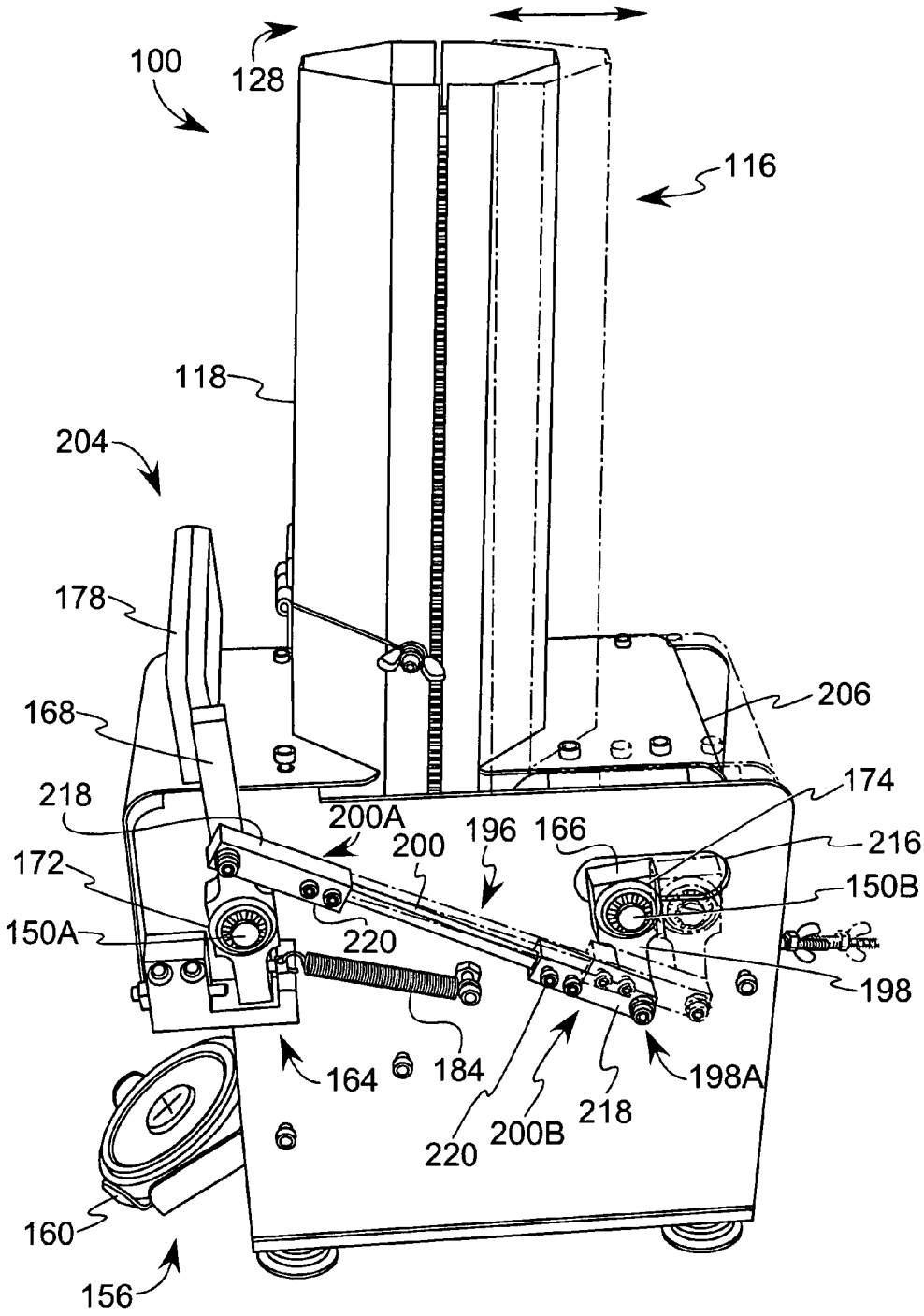
FIG. 5 is a side view of the lid dispenser of FIG. 1 illustrating that the housing may comprise a fixed housing portion and an adjustable housing portion that may be repositioned with respect to the fixed housing portion to accommodate lids having various circumferences.

To ensure that the first and second indexing shafts 150A, 150B cooperate to discharge a lid upon actuation of the lever 162, a linkage 196 is provided between the first and second driving devices 164, 166. Referring to FIG. 5, the linkage 196 is configured such that rotation of one of the first and second driving devices 164, 166 causes opposite rotational movement of the other one of the first and second driving devices 164, 166, which in turn causes opposite rotational movement of the first and second indexing shafts 150A, 150B (not shown).

The second driving device 166 includes a swing extension 198 extending radially out from the second one-way bearing 174. The linkage 196 includes a link arm 200 that interconnects the first and second one-way bearings 172, 174 by coupling between the swing extension 198 and the first handle member 168. Particularly, the link arm 200 is operatively configured such that operation of the dispensing mechanism 162 causes the first and second indexing shafts 150A, 150B to rotate in opposite directions so as to pass a lid 126 through the nip point between the grippers and onto the lid discharge area. For example, the link arm 200 may be coupled to the first handle member 168 generally above the one-way bearing 172. The link arm 200 extends towards the back of the dispenser 100, and couples to a first end 198A of the swing extension 198. The swing extension 198 extends generally downward with respect to the second one-way bearing 172 as shown.

The link arm 200 is preferably adjusted such that a first end 200A of the link arm 200 is conceptually positioned with respect to an axis defined by the first indexing shaft 150A to be approximately 180 degrees offset from a second end 200B of the link arm 200, which is conceptually positioned with respect to an axis defined by the second indexing shaft 150B. For example, if the first handle member 168 were positioned substantially vertically, the first end 200A of the link arm 200 is conceptually positioned at 12 o'clock relative to the first one-way bearing 172, and the second end 200B of the link arm 200 is positioned at approximately 6 o'clock relative to the second one-way bearing 174.

Referring to FIGS. 2 and 5, in operation, the spring 184 urges the first handle member 168 against the first abutment surface 182. The first abutment surface 182 further serves as a stop to limit the forward movement of the second handle member 170. Upon a user pushing the second handle member 170, the first handle member 168 rotates about the one-way bearing 172 in a first direction (clockwise in this example) causing unitary rotational motion of the first indexing shaft 150A with respect to the first handle member 168. As the first handle member 168 rotates in the first direction (clockwise as shown), the linkage 196 causes the swing extension 198 and corresponding second indexing shaft 150B to rotate in a second direction (counterclockwise as shown). The user continues to push the lever 162 until the first handle member 168 stops due to interference by the second abutment surface 188 defined by the repositioning device 194, e.g., the set screw. The degree of rotational motion of the first handle member 168 between the first and second abutment surfaces 182, 188 is adjusted to correspond to a degree of rotational movement of the first and second indexing shafts 150A, 150B sufficient to transition the stack of lids in a linear manner downward so as to discharge a single lid 126 from the dispenser 100.

When the operator lets go of the second handle member 170 after successfully discharging a lid 126, the spring 184 counter rotates the first handle member 168 back to the first position where the lower end portion 168A of the first handle member 168 is urged against the first abutment surface 182. However, as the first handle member 168 rotates in a second direction opposite the first direction, the one-way bearing 172 slips with respect the first indexing shaft 150A, thus the first indexing shaft 150A does not rotate (counterclockwise in this example) with the first handle member 168. Rather, the first indexing shaft 150A remains stationary as the first handle member 168 rotates back into position. Correspondingly, the rotation of the first handle member 168 causes the swing extension 198 to rotate back to its default position via the linkage 196. However, the second one way bearing 174 coupled to the swing extension 198 slips with respect to the second indexing shaft 150B, thus the second indexing shaft 150B does not rotate back with the swing extension 198. Accordingly, each actuation of the lever 162 linearly advances the stack of lids 126 downward by one lid position.

By adjusting the repositioning device 194, e.g., the setscrew, the degree of rotational movement of the first handle member 168 is regulated. For example, by transitioning the set screw towards the first abutment surface 182, the degree of rotational movement is limited, thus limiting the degree of rotational motion of the first and second indexing shafts 150A, 150B, correspondingly affecting the linear travel imparted to the stack of lids to pass a lid 126 through the nip point between the grippers 146. As the set repositioning device 194, e.g., the setscrew, is moved further away from the first abutment surface 182, the degree of rotational movement possible by the first handle member 168 is increased, which translates into increased rotational motion of the first and second indexing shafts 150A, 150B and corresponding linear movement of the vertical stack of lids.

Referring to FIG. 5, the dispenser 100 may be made adjustable to accommodate a variety of lid sizes (i.e. the circumference of the lids). As shown, the housing 102 includes a fixed housing portion 204 and an adjustable housing portion 206. The first indexing shaft 150A corresponds to the fixed housing portion 204 and the second indexing shaft 150B corresponds to the adjustable housing portion 206. To accommodate different circumference lids, the adjustable housing portion 206 is appropriately positioned relative to the fixed housing portion 204 so as to achieve a suitable spacing between the first and second indexing shafts 150A, 150B. By incorporating the first support member 118 of the lid stack holder 116 with the fixed housing portion 204, and the second support member 120 of the lid stack holder 116 with the adjustable housing portion 206, a single adjustment can set the appropriate spacing for both the lid stack holder 116 and the first and second indexing shafts 150A, 150B. That is, the lid stack holder 116 may be made automatically adjustable to the appropriate circumference of the particular lids 126 to be dispensed, by means of the adjustment to the adjustable housing portion 206. Alternatively, the second indexing shaft 150B may be made adjustable housing 102 independently of the lid stack holder 116.

Figure 7:
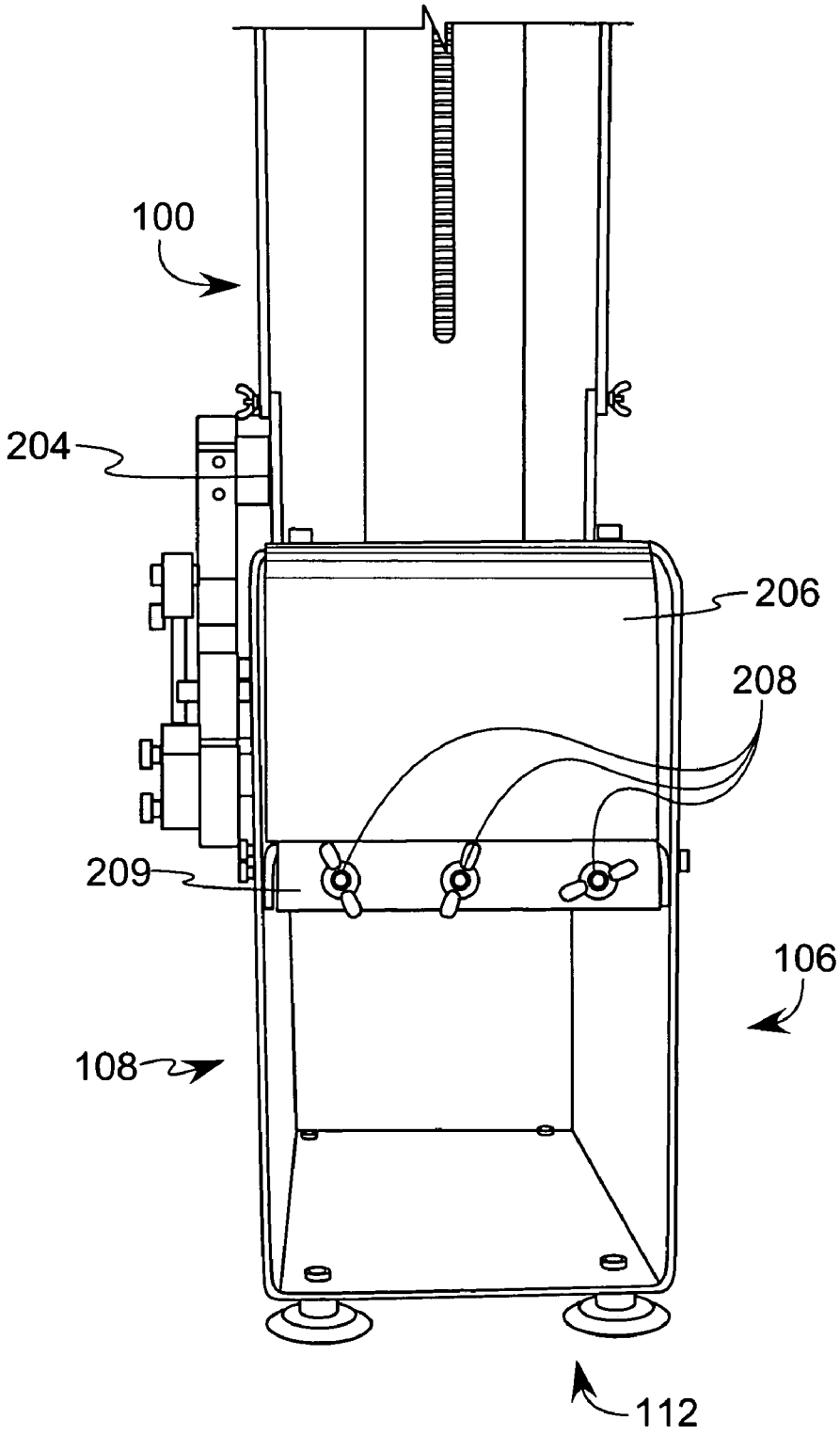
FIG. 7 is a rear view of the dispenser of FIG. 1.
Figure 8:
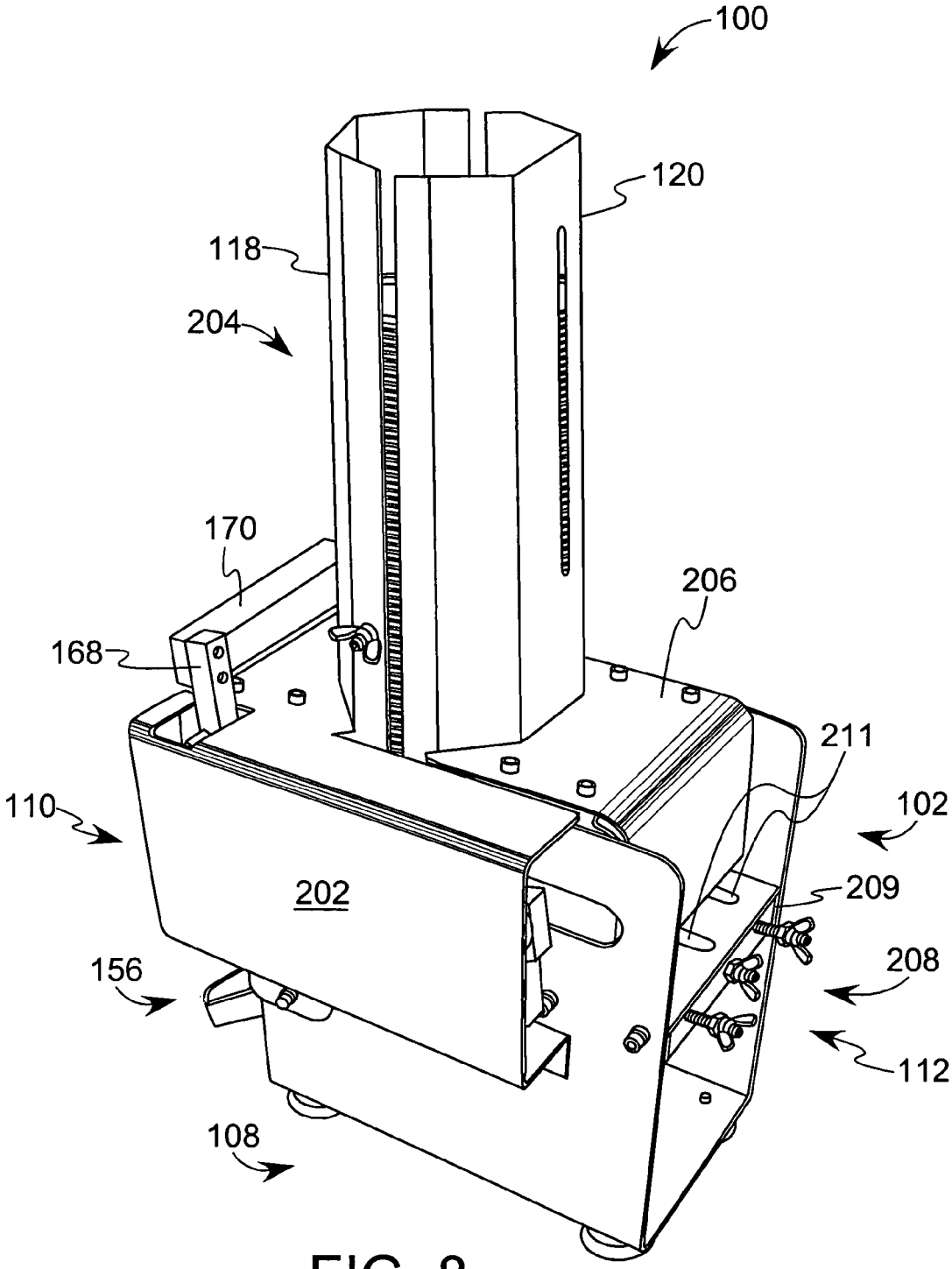
FIG. 8 is a perspective view taken at an angle and from the side of the lid dispenser of FIG. 1 illustrating a cover placed over some of the controls.

The adjustable housing portion 206 may be adjusted to an appropriate position in a direction perpendicular to the axial direction of the first and second indexing shafts 150A, 150B. For example, where the first and second indexing shafts include an axial shaft direction that extends from side to side of the housing 102, the adjustable housing portion 206 is made to be adjustable in a direction front to back of the dispenser 100. This allows the dispenser 100 to be reconfigured to accommodate different lid circumferences. For example, as best seen in FIGS. 4, 7 and 8, an adjustment control 208, such as one or more wing nuts and screws are used to stabilize and drive the adjustable housing portion 206 to the appropriate position based upon the size of the lid to be dispensed. With reference to FIG. 8, the adjustment control 208 determines the position of the adjustable housing portion 206 relative to an adjustment plate 209, which is part of the fixed housing portion 204. The adjustment plate 209 includes one or more slots 211 there along for receiving a drive engaging member 212 of the adjustable housing portion 206 and optionally, one or more locking members 213.

As the center adjustment control 208 is turned, the drive engaging member 212, which is threadably received by a screw type adjustment device 214, linearly transitions the adjustable housing portion 206. Thus, the second indexing shaft 150B is repositioned relative to the first indexing shaft 150A. The adjustable housing portion 206 may then be locked into place once the adjustable housing portion 206 is in the appropriate position. For example, as shown, the two outer adjustment controls 208 can be used to lock the adjustable housing portion 206 relative to the fixed housing portion 204 by threading into their corresponding locking members 213.

As best seen in FIG. 5, the side of the housing that supports the dispensing mechanism 160 proximate the second driving device 166 includes a slot 216 therein. The slot 216 may define the relative range of adjustments afforded by repositioning the adjustable housing portion 206 to accommodate for different lid circumferences. Alternatively, discrete shaft holes or other reasonable adjustment arrangements may be provided. As such, the range of adjustment may be continuous, or provided in discrete steps. To accommodate the repositioning of the second indexing shaft 150B, the link arm 200 is adjustably received into a link arm receiving member 218. The link arm receiving member 218 couples between the link arm 200 and the swing extension 198. The link arm receiving member 218 may alternatively be positioned at the first handle member 168 or two link arm receiving members 218 may be provided, one at each end of the link arm 200. The link arm receiving member 218 slidingly receives the link arm 200 therein. A locking member 220, such one or more set screws is used to lock the link arm 200 relative to the link arm receiving member 218. If an adjustment is made to distance between the first and second indexing shafts 150A, 150B, a corresponding adjustment to the link arm 200.

Figure 9:
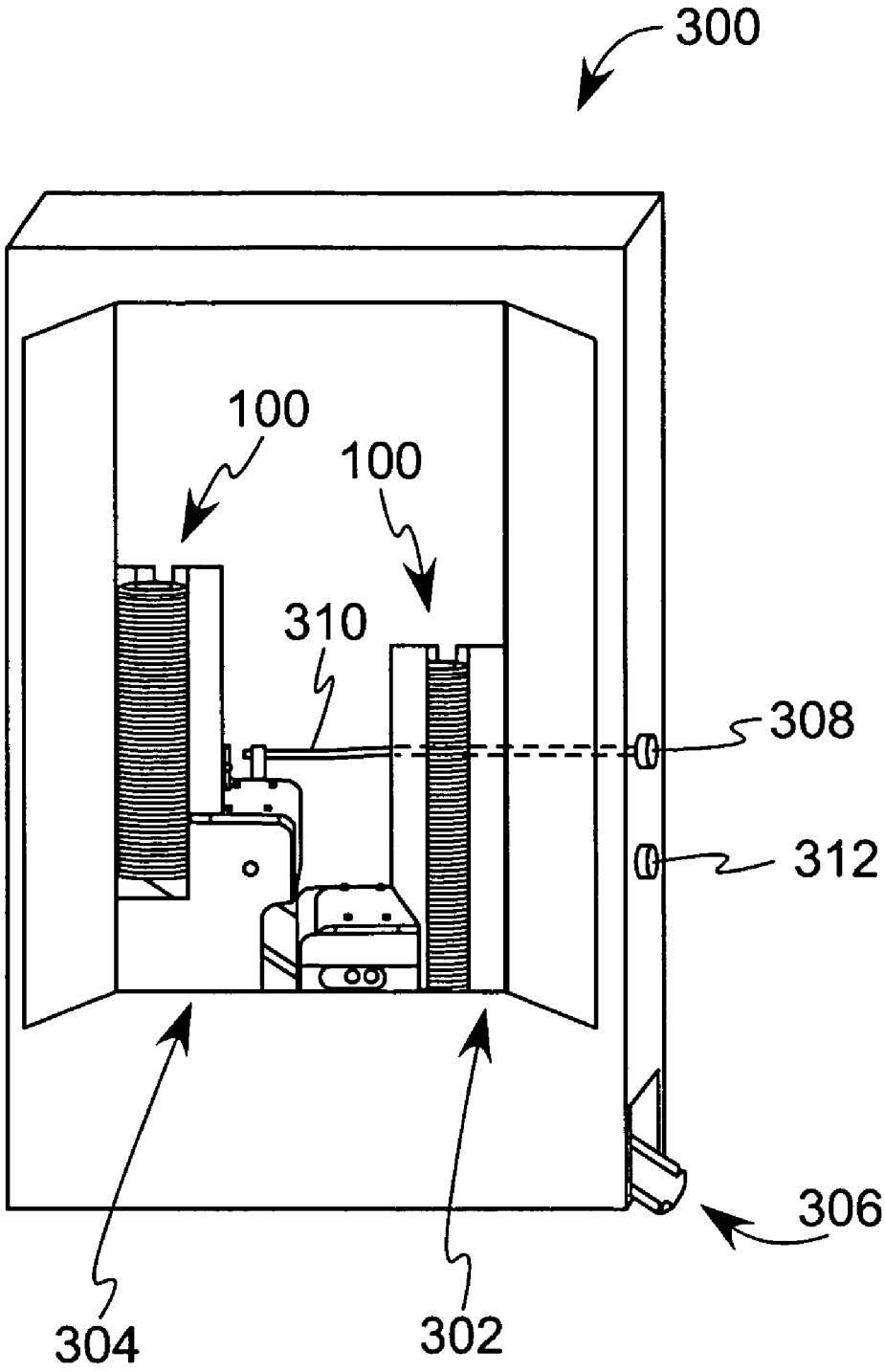
FIG. 9 shows a pair of dispensers installed in a dispenser cabinet, wherein the dispensers are arranged in tandem such that each dispenser shares a common lid discharge area.

Referring briefly to FIG. 8, a guard 202 may be provided to cover and protect select components of the dispensing mechanism 160. Additionally, and/or alternatively, one or more dispensers 100 can be arranged in a single lid dispensing cabinet 300 as shown in FIG. 9. As shown, two lid dispensers including a forward dispenser 302 and a rearward dispenser 304 may be arranged in tandem with the rearward dispenser 304 positioned vertically higher than the forward dispenser 302. The forward and rearward dispensers 302, 304 are constructed similar in construction to the dispenser 100 discussed with reference to FIGS. 1-8. The forward and rearward dispensers 302, 304 are arranged such that a common lid discharge area 306 is provided towards the front of the cabinet 300 for retrieving lids dispensed from either the forward dispenser 302 or the rearward dispenser 304. The forward and rearward dispensers 302, 304 may be configured to dispense lids of different or the same size, height and/or type, depending upon the particular application. For example, the forward dispenser may be adjusted to accommodate lids having a diameter "A" and the rearward dispenser may be configured to dispense lids having a diameter "B" where A and B are not equal. As shown, there are two push buttons located on the cabinet 300. The topmost button 308 is coupled to an extending linkage 310 back to the rearward dispenser 304 for dispensing lids therefrom. The bottommost button 312 is coupled to the forward dispenser 302 for dispensing lids therefrom. While two dispensers 302, 304 are shown in tandem for purposes of illustration, the invention is not so limited, and the dispensers 302, 304 can be arranged in the cabinet in any reason able manner.

Having described the invention in detail and by reference to preferred embodiments thereof, it will be apparent that modifications and variations are possible without departing from the scope of the invention defined in the appended claims.

What is claimed is:

1. A lid dispenser for sequentially dispensing flexible lids, the dispenser comprising:

a housing having a lid stack area for storing a substantially vertical stack of flexible lids;

a pair of indexing shafts positioned within said housing generally below said lid stack area, said pair of indexing shafts arranged to grip at least a bottom-most lid of said stack of flexible lids;

a lid discharge area arranged to deliver a lid dispensed from said lid stack area to an operator accessible location; and a dispensing mechanism manually operable to cause said pair of indexing shafts to rotate in opposite directions a sufficient amount to pass said bottom-most lid of said stack of flexible lids into said lid discharge area; wherein:

said dispensing mechanism comprises an adjustment control having a stop that allows a degree of rotation of said pair of indexing shafts to be adjusted so that for each manual operation of said dispensing mechanism, said rotation of said pair of indexing shafts is limited to an amount sufficient to pass said bottom-most lid of said stack of flexible lids into said discharge area, thus accommodating a variety of lid configurations.

2. The lid dispenser according to claim 1, wherein said dispensing mechanism comprises a first drive device arranged to rotate at least one of said pair of indexing shafts, and said stop comprises an adjustable stop member that limits a degree of rotation of said first drive device.

3. The lid dispenser according to claim 2, wherein said dispensing first drive device is coupled to a first one shaft of said pair of indexing shafts by a device that allows said first one shaft to rotate in only a single direction.

4. The lid dispenser according to claim 2, wherein said stop member comprises a block having an adjustable abutment surface that is adjustable to limit said degree of rotation of said first drive device.

5. The lid dispenser according to claim 2, wherein said first drive device comprises a handle having a shaft that couples to a first one of said pair of indexing shafts so as to pivot thereabout, said handle including a terminal end spaced radially from said first one of said pair of indexing shaft that is received between first and second abutment surfaces, wherein said second abutment surface includes an adjustment that limits the rotation of said handle about said first indexing shaft by restricting the range of travel of said terminal end between said first and second abutment surfaces.

6. The lid dispenser according to claim 1, wherein said first indexing shaft is coupled to said second indexing shaft by a linkage arm arranged such that rotation of said first indexing shaft in a first direction causes said second shaft to rotate a nominally equal amount, but in an opposite direction so as to pass said bottom-most lid.

7. The lid dispenser according to claim 1, further comprising a gripper provided on each of said first and second indexing shafts, wherein each gripper comprises a plurality of disks arranged such that the diameter of disks towards the end portions of said gripper are nominally larger than the diameter of disks towards the middle portion of said gripper relative to at least said bottom-most lid of said stack of flexible lids.

8. The lid dispenser according to claim 7, wherein a circumference of each of said disks of said grippers is sized to generally conform to the circumference of the lids in said stack of lids.

9. The lid dispenser according to claim 7, wherein said grippers each further comprise a plurality of spacers between each of said disks, said spacers arranged to allow said disks to spread out axially along said indexing shaft so as to adjust varying circumferences of stacks of lids placed in said dispensing device.

10. The lid dispenser according to claim 7, wherein each of said grippers follows generally a contour of said bottom-most lid so as to grip said bottom-most lid in a plurality of positions.

11. The lid dispenser according to claim 1, wherein said adjustable control comprises a block having a recessed portion arranged to receive a lower portion of a handle which is coupled to a first one of said pair of indexing shafts.

12. A lid dispenser for sequentially dispensing flexible lids, the dispenser comprising:

a housing;

a lid stack holder from a top portion of said housing, said lid stack holder having a first support member that is adjustably spaced from a second support member so as to accommodate stacks of flexible lids having varying diameters, said first and second support members cooperating to support a loaded substantially vertical stack of flexible lids, first and a second indexing shafts positioned generally below said lid stack holder, said first and second indexing shafts arranged to grip at least a bottom-most lid of said stack of flexible lids, a lid discharge area arranged to deliver a dispensed lid to an operator accessible location;

a dispensing mechanism arranged such that for each manual operation of said dispensing mechanism, said pair of indexing shafts rotate a limited amount that is sufficient to pass said bottom-most lid of said stack of flexible lids into said lid discharge area, and an adjustment control that is adjusted to set a position of said second indexing shaft relative to said first indexing shaft.

13. The lid dispenser according to claim 12, wherein said housing comprises a first housing portion and a second housing portion, said second housing portion being repositionable with respect to said first housing portion, and said second portion including said second support member of said lid stack, and said second indexing shaft.

14. The lid dispenser according to claim 12, wherein said first indexing shaft is coupled to said second indexing shaft by a linkage arm arranged such that rotation of said first indexing shaft in a first direction causes said second shaft to rotate a nominally equal amount, but in an opposite direction so as to pass said bottom-most lid from said grippers.

15. The lid dispenser according to claim 14, wherein said linkage arm includes at least one adjustment that allows the length of said linkage arm to be selectively lengthened or shortened by an amount appropriate to the relative adjusted position of said second indexing shaft with respect to said first indexing shaft.

16. The lid dispenser according to claim 12, further comprising a gripper provided on each of said first and second indexing shafts, wherein each gripper comprises a plurality of generally cylindrical disks arranged such that the diameter of ones of said plurality of disks at the end portions of said gripper are nominally larger than the ones of said plurality of disks at the middle portion of said gripper.

17. The lid dispenser according to claim 16, wherein a circumference of each of said disks is sized to generally conform to the circumference of the lids in said stack of lids.

18. The lid dispenser according to claim 16, wherein said grippers each further comprise a plurality of spacers between each of said disks, said spacers arranged to allow said disks to spread out axially along said indexing shaft so as to adjust varying circumferences of stacks of lids placed in said dispensing device.

19. The lid dispenser according to claim 16, wherein each of said grippers follows generally a contour of said bottom-most lid so as to grip said bottom-most lid in a plurality of positions.

20. A lid dispenser for sequentially dispensing flexible lids, the dispenser comprising:

a lid stack holder having a first support member and a second support member, said first and second support members cooperating to support a substantially vertical stack of flexible lids, wherein said second support member is repositionable with respect to said first support member to accommodate lids of varying diameter;

first and a second indexing shafts positioned generally below said lid stack holder, said first and second indexing shafts arranged to grip at least a bottom-most lid of said stack of flexible lids, an adjustment control that is adjusted to set a position of said second indexing shaft relative to said first indexing shaft to accommodate lids of varying diameters, a lid discharge area arranged to deliver a dispensed lid to a location accessible to a user;

a dispensing mechanism manually operable to cause said pair of indexing shafts to rotate in opposite directions a sufficient amount to pass said bottom-most lid of said stack of flexible lids into said lid discharge area; wherein:

said dispensing mechanism comprises an adjustment control having a stop that allows a degree of rotation of said pair of indexing shafts to be adjusted so that for each manual operation of said dispensing mechanism, said rotation of said pair of indexing shafts is limited to an amount sufficient to pass said bottom-most lid of said stack of flexible lids into said discharge area, thus accommodating a variety of lid configurations.

21. A dispensing device for dispensing flexible lids comprising:

a generally enclosed housing having at least one access door;

at least two dispensing devices arranged within said housing, each dispensing device having:

a pair of indexing shafts positioned generally below a corresponding lid stack area, said pair of indexing shafts arranged to grip at least a bottom-most lid of a stack of flexible lids:

a gripper having a plurality of disks on each of said pair of indexing shafts wherein said disks are arranged such that the diameter of disks towards the end portions of said gripper are nominally larger than the diameter of disks towards the middle portion of said gripper relative to at least said bottom-most lid of said stack of flexible lids;

a lid discharge area common to said at least two dispensing devices;

a first manually operable control for discharging a bottom-most lid from a said stack of lids corresponding to a first one of said at least two devices upon operation of said first manually operable control; and a second manually operable control for discharging a bottom-most lid from said stack of lids corresponding to a second one of said at least two devices upon operation of said second manually operable control.

22. A lid dispenser for sequentially dispensing flexible lids, the dispenser comprising:

a housing having a lid stack area for storing a substantially vertical stack of flexible lids;

a pair of indexing shafts positioned within said housing generally below said lid stack area, said pair of indexing shafts arranged to grip at least a bottom-most lid of said stack of flexible lids;

a gripper having a plurality of disks on each of said pair of indexing shafts wherein said disks are arranged such that the diameter of disks towards the end portions of said gripper are nominally larger than the diameter of disks towards the middle portion of said gripper relative to at least said bottom-most lid of said stack of flexible lids;

a lid discharge area arranged to deliver a lid dispensed from said lid stack area to an operator accessible location; and a dispensing mechanism manually operable to cause said pair of indexing shafts to rotate in opposite directions a sufficient amount to pass said bottom-most lid of said stack of flexible lids into said lid discharge area.

23. The lid dispenser according to claim 22, wherein a circumference of each of said disks is sized to generally conform to the circumference of the lids in said stack of lids.

24. The lid dispenser according to claim 22, wherein said grippers each further comprise a plurality of spacers between each of said disks, said spacers arranged to allow said disks to spread out axially along said indexing shaft so as to adjust varying circumferences of stacks of lids placed in said dispensing device.

25. The lid dispenser according to claim 22, wherein each of said grippers follows generally a contour of said bottom-most lid so as to grip said bottom-most lid in a plurality of positions.

26. The lid dispenser according to claim 22, wherein said disks comprise a pliable material.

27. The lid dispenser according to claim 22, further comprising at least one of a biasing spring or a spacer on each of said pair of indexing shafts to bias the position the disks with respect to said vertical stack of lids.

* * * * *